US011404200B2

(12) United States Patent
Arai et al.

(10) Patent No.: US 11,404,200 B2
(45) Date of Patent: Aug. 2, 2022

(54) SURFACE-MOUNT INDUCTOR

(71) Applicant: Murata Manufacturing Co., Ltd., Kyoto-fu (JP)

(72) Inventors: Takumi Arai, Nagaokakyo (JP); Ryuta Uematsu, Nagaokakyo (JP); Koichi Saito, Nagaokakyo (JP); Kazuhide Kudo, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 667 days.

(21) Appl. No.: 16/289,219

(22) Filed: Feb. 28, 2019

(65) Prior Publication Data

US 2019/0272946 A1 Sep. 5, 2019

(30) Foreign Application Priority Data

Mar. 1, 2018 (JP) ..... JP2018-036900

(51) Int. Cl.
*H01F 27/02* (2006.01)
*H01F 27/29* (2006.01)
(Continued)

(52) U.S. Cl.
CPC ..... *H01F 27/292* (2013.01); *H01F 17/06* (2013.01); *H01F 27/2847* (2013.01); *H01F 27/327* (2013.01); *H01F 2017/048* (2013.01)

(58) Field of Classification Search
CPC ..... H01F 27/29
(Continued)

(56) References Cited

U.S. PATENT DOCUMENTS

2009/0128275 A1 5/2009 Yagasaki et al.
2011/0043317 A1* 2/2011 Ikriannikov ..... H01F 17/06 336/192
(Continued)

FOREIGN PATENT DOCUMENTS

CN 101499360 A 8/2009
CN 103915236 A 7/2014
(Continued)

OTHER PUBLICATIONS

An Office Action; "Notice of Reasons for Refusal," dated by the Japanese Patent Office dated Jul. 13, 2021, which corresponds to Japanese Patent Application No. 2020-169088 and is related to U.S. Appl. No. 16/289,219 with with English translation.
(Continued)

*Primary Examiner* — Ronald Hinson
(74) *Attorney, Agent, or Firm* — Studebaker & Brackett PC

(57) ABSTRACT

A surface-mount inductor includes a molded body and a metallic plate. The metallic plate has a first metallic plate portion embedded in the molded body such that an extension direction and a width direction thereof are parallel to the mounting surface; second metallic plate portions extending from both end portions, in the extension direction, of the first metallic plate portion to a bottom surface of the molded body in a direction to the mounting surface; and third metallic plate portions disposed to extend from the second metallic plate portions along the bottom surface of the molded body and be separated from side surfaces adjacent to the bottom surface of the molded body. Each of the third metallic plate portions has at least a surface exposed from the molded body. End portions of the metallic plate are embedded to be separated from the side surfaces of the molded body.

4 Claims, 3 Drawing Sheets

(51) Int. Cl.

| | |
|---|---|
| ***H01F 27/32*** | (2006.01) |
| ***H01F 17/06*** | (2006.01) |
| ***H01F 27/28*** | (2006.01) |
| *H01F 17/04* | (2006.01) |

(58) Field of Classification Search
USPC ..... 336/90
See application file for complete search history.

(56) References Cited

U.S. PATENT DOCUMENTS

2011/0169476 A1* 7/2011 Ikriannikov ..... H02M 3/1584 323/362
2011/0279100 A1* 11/2011 Ikriannikov ..... H01F 3/08 323/271
2014/0266541 A1* 9/2014 Sakamoto ..... H01F 27/292 336/192
2016/0055954 A1 2/2016 Huang et al.

FOREIGN PATENT DOCUMENTS

| | | | |
|---|---|---|---|
| EP | 3 249 661 | A1 | 11/2017 |
| JP | S62-134201 | U | 8/1987 |
| JP | H05-36811 | A | 2/1993 |
| JP | 2017-037891 | A | 2/2017 |
| JP | 2017-510072 | A | 4/2017 |

OTHER PUBLICATIONS

An Office Action; "Notification of Reasons for Refusal," dated by the Japanese Patent Office dated Jun. 30, 2020, which corresponds to Japanese Patent Application No. 2018-036900 and is related to U.S. Appl. No. 16/289,219 with English language translation.

* cited by examiner

SURFACE-MOUNT INDUCTOR

CROSS-REFERENCE TO RELATED APPLICATION

This application claims benefit of priority to Japanese Patent Application No. 2018-036900, filed Mar. 1, 2018, the entire content of which is incorporated herein by reference.

BACKGROUND

Technical Field

The present disclosure relates to a surface-mount inductor.

Background Art

An electronic component has been known in which a metallic plate extended from a coil conductor included in a body is bent to form an external terminal. Japanese Unexamined Patent Application Publication No. 2017-37891 discloses an electronic component in which metallic plates are disposed on a mount surface and a side surface, connected to a coil conductor, and bent and which allows a solder fillet to be visually confirmed. Japanese Unexamined Utility Model Registration Application Publication No. 5-36811 discloses a bead inductor in which a bead core through hole is provided, a bent electrode plate is inserted thereinto, and the extended electrode plate is bent, and an assembling process for the bead electrode is simplified.

Regarding an conventional electronic component for which a body in which a coil is housed is molded and then a metallic plate extended out of a body is bent to form an external terminal, the body may be damaged when the metallic plate is bent if the size of the electronic component is reduced. In a conventional electronic component in which external terminals are disposed on a mount surface and a side surface of a body, a solder fillet is formed on the side surface at the time of mounting, so that a requirement of high-density mounting is not sufficiently satisfied in some cases.

SUMMARY

The present disclosure provides a surface-mount inductor in which damage to a molded body accompanying formation of an external terminal is inhibited and which is able to achieve high-density mounting.

According to preferred embodiments of the present disclosure, a surface-mount inductor includes a molded body formed from a composite material containing magnetic powder, and a metallic plate embedded in the molded body so as to be partially exposed at a mounting surface side. The metallic plate has: a first metallic plate portion that is embedded in the molded body such that an extension direction and a width direction thereof are parallel to the mounting surface; second metallic plate portions that respectively extend from both end portions, in the extension direction, of the first metallic plate portion to a bottom surface of the molded body in a direction to the mounting surface; and third metallic plate portions that are disposed so as to extend from the second metallic plate portions along the bottom surface of the molded body and be separated from side surfaces adjacent to the bottom surface of the molded body. Also, each of the third metallic plate portions has at least a surface exposed from the molded body. End portions of the metallic plate are embedded so as to be separated from the side surfaces of the molded body.

According to the present disclosure, it is possible to provide a surface-mount inductor in which damage to a molded body accompanying formation of an external terminal is inhibited and which is able to achieve high-density mounting.

Other features, elements, characteristics and advantages of the present disclosure will become more apparent from the following detailed description of preferred embodiments of the present disclosure with reference to the attached drawings.

DESCRIPTION OF THE PREFERRED EMBODIMENTS

Figure 1A:
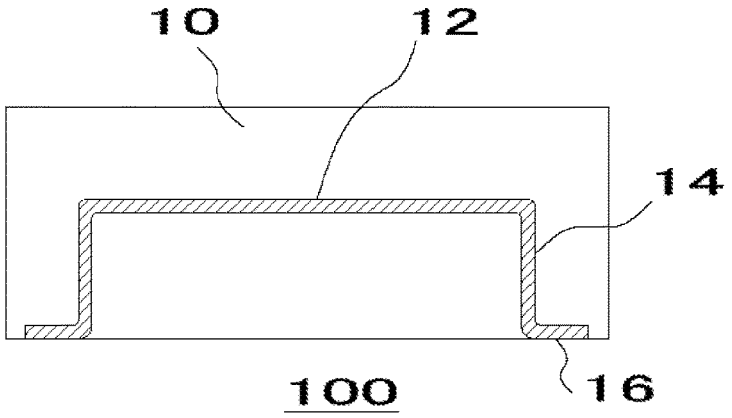
FIG. 1A is a cross-sectional view showing an example of a surface-mount inductor of a first embodiment.

A surface-mount inductor includes a molded body formed from a composite material containing magnetic powder, and a metallic plate embedded in the molded body so as to be partially exposed at a mounting surface side. The metallic plate has a first metallic plate portion that is embedded in the molded body such that an extension direction and a width direction thereof are parallel to the mounting surface; second metallic plate portions that respectively extend from both end portions, in the extension direction, of the first metallic plate portion to a bottom surface of the molded body in a direction to the mounting surface within the molded body; and third metallic plate portions that are disposed so as to extend from the second metallic plate portions along the bottom surface of the molded body and be separated from side surfaces adjacent to the bottom surface of the molded body. Also, each of the third metallic plate portions has at least a surface exposed from the molded body. End portions of the metallic plate are embedded so as to be separated from the side surfaces of the molded body.

In the surface-mount inductor, each third metallic plate portion, which is extended from the bottom surface that is the mounting surface side of the molded body, is disposed along the bottom surface so as to be separated from the side surface adjacent to the bottom surface, thereby forming an external terminal, and the end portions of the metallic plate are embedded in the molded body. Thus, the fixing strength between the molded body and the external terminal is good.

In addition, in the surface-mount inductor, the end portions of the external terminals are not exposed on the side surfaces of the molded body. Thus, solder fillets are not formed on the side surfaces of the molded body at the time of mounting, and it is possible to improve the mounting density while favorable mounting strength is maintained.

The metallic plate may further have fourth metallic plate portions that extend from end portions of the third metallic plate portions at sides opposite to the second metallic plate portions, in a direction crossing a top surface of the molded body opposing the mounting surface. Accordingly, the fourth metallic plate portions, which are the ends of the metallic plate, are inserted into the molded body again, and thus the fixing strength between the molded body and the external terminals is further improved.

Each third metallic plate portion may extend from the second metallic plate portion in a direction to the second metallic plate portion to which the other third metallic plate portion is connected. Accordingly, the two external terminals are disposed along the bottom surface of the molded body in directions approaching each other, and thus it is possible to sufficiently ensure the length of the first metallic plate portion and it is possible to easily achieve desired inductance at a coil conductor portion composed of the first metallic plate portion, the second metallic plate portions, and the third metallic plate portions.

The magnetic powder may include metallic magnetic powder. Accordingly, the molded body is formed containing the metallic magnetic powder, and thus the direct current superposition characteristics are further improved.

Each third metallic plate portion may have a plating layer on the surface thereof exposed from the molded body. Accordingly, the wettability of the external terminals to solder to solder at the time of mounting is improved, and the mounting strength is further improved.

As used herein, the term "process" not only includes an independent process but also includes a process that is not clearly distinguishable from another process, as long as the initial object of the process is achieved. Hereinafter, embodiments of the present disclosure will be described with reference to the drawings. It should be noted that the embodiments described below are intended to illustrate surface-mount inductors for embodying the technical idea of the present disclosure, and the present disclosure is not limited to the surface-mount inductors described below. Members recited in the claims are not limited to members of the embodiments at all. In particular, the scope of the present disclosure is not limited to dimensions, materials, shapes, relative arrangements, etc., of constituent parts described in the embodiments unless specifically described, and they are only explanatory examples. In each drawing, the same parts are designated by the same reference signs. Although the embodiments are separately described for convenience in consideration of the description of main points or ease of understanding, components described in different embodiments may be partially replaced or combined with each other. Description of points common to a first embodiment will be omitted and only the points different from the first embodiment will be described in second and subsequent embodiments. In particular, similar effects and advantages achieved by similar components are not duplicated in each embodiment.

EMBODIMENTS

First Embodiment

Figure 1B:
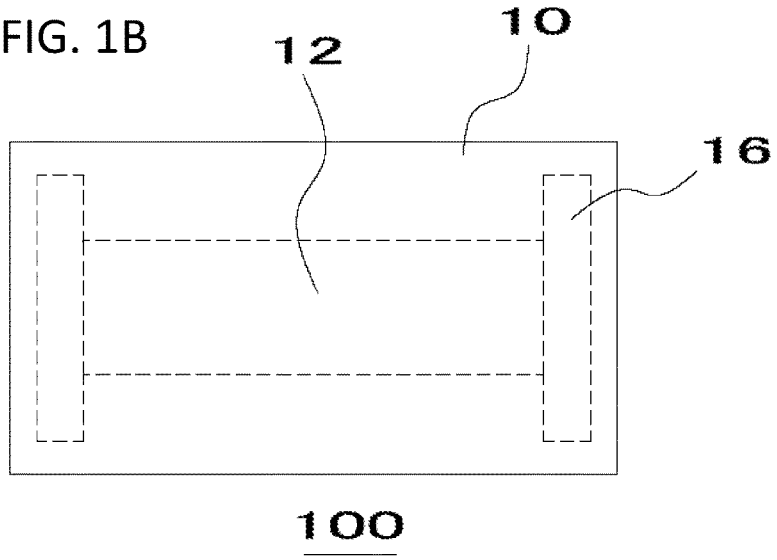
FIG. 1B is a perspective plan view of the surface-mount inductor in FIG. 1A as seen from the side opposite to a mounting surface.

A surface-mount inductor 100 of the first embodiment will be described with reference to FIGS. 1A and 1B. FIG. 1A is a cross-sectional view of the surface-mount inductor 100. FIG. 1B is a perspective plan view of the surface-mount inductor 100 as seen from the side opposite to a mounting surface.

As shown in FIG. 1A, the surface-mount inductor 100 includes a molded body 10 and a metallic plate embedded within the molded body 10. The molded body 10 formed from a composite material containing magnetic powder and has a bottom surface at the mounting surface side, a top surface opposing the bottom surface, and four side surfaces adjacent to the bottom surface and the top surface. The metallic plate has a first metallic plate portion 12, second metallic plates portion 14, and third metallic plate portions 16.

The first metallic plate portion 12 is embedded such that an extension direction and a width direction of the metallic plate are parallel to the mounting surface of the molded body 10. That is, the first metallic plate portion 12 is embedded such that a surface thereof orthogonal to the thickness direction of the metallic plate is parallel to the mounting surface of the molded body 10. The first metallic plate portion 12 has a thickness in a direction orthogonal to the extension direction and the width direction of the metallic plate.

The second metallic plate portions 14 respectively extend from both end portions, in the extension direction, of the first metallic plate portion 12 toward the mounting surface and is extended from the bottom surface of the molded body 10. Each second metallic plate portion 14 is disposed so as to be separated from the side surface of the molded body 10.

Each of the two third metallic plate portions 16 is disposed along the bottom surface of the molded body 10 so as to extend from the end portion, at the mounting surface side, of the second metallic plate portion 14 toward the side opposite to the second metallic plate portion 14 to which the other third metallic plate portion 16 is connected. An end portion of each third metallic plate portion 16 at the side opposite to the second metallic plate portion 14, that is, an end portion of the metallic plate, is embedded in the molded body 10 such that an end surface thereof is not exposed from the side surface of the molded body 10. Each third metallic plate portion 16 forms an external terminal of a surface-mount inductor such that at least a part of the side surface thereof is embedded in the molded body 10 and the surface thereof opposite to the molded body 10 is exposed from the bottom surface of the molded body 10. In addition, the first metallic plate portion, the second metallic plate portions, and the third metallic plate portions form a coil conductor of the surface-mount inductor 100.

In FIG. 1A, the second metallic plate portion 14 is substantially orthogonal to the bottom surface of the molded body 10, but the extension direction of each second metallic plate portion 14 may intersect the bottom surface of the molded body 10 at an acute angle or an obtuse angle.

In FIG. 1B, the first metallic plate portion 12 of the metallic plate is disposed so as to be separated from two side surfaces of the molded body 10 that are orthogonal to the lateral direction of the molded body 10, and extends in the longitudinal direction of the molded body 10. Each third metallic plate portion 16 is connected to the first metallic plate portion 12 via the second metallic plate portion (not shown), which is provided at each of both end portions of the first metallic plate portion 12. The width of each third metallic plate portion 16 in a direction parallel to the lateral direction of the molded body 10 is smaller than the width of the molded body 10 in the lateral direction thereof, and end portions, in the width direction, of each third metallic plate portion 16 are disposed so as to be separated from the side surfaces of the molded body 10, respectively. In FIG. 1B, the width of each third metallic plate portion 16 parallel to the lateral direction of the molded body 10 is larger than the width of the first metallic plate portion 12, but may be substantially equal to the width of the first metallic plate portion 12. Although not shown, the width of each second metallic plate portion may be smaller than that of each third metallic plate portion 16 and substantially equal to that of the first metallic plate portion 12.

The composite material that forms the molded body 10 may contain a binder such as a resin in addition to the magnetic powder. As the magnetic powder, for example, ferrite particles, or metallic magnetic particles such as a metallic magnetic material containing iron, or an amorphous alloy, a nanocrystal, or the like may be used. As the binder, a thermosetting resin such as an epoxy resin is used. The metallic plate is formed from, for example, a conductive metal such as copper and may have a plating layer on at least one surface thereof.

For example, the molded body 10 is formed in a so-called 252010 size in which a longitudinal length, which is a length in the longitudinal direction, is about 2.5 mm, a lateral length, which is a length in the lateral direction, is about 2.0 mm, and a height, which is the distance between the bottom surface and the top surface, is about 1.0 mm. In addition, the metallic plate is formed from, for example, a metallic base material having a thickness of about 150 μm and made of copper. Regarding the line width of the metallic plate, for example, the line width of the first metallic plate portion 12 may be about 600 μm, and the line width of each third metallic plate portion 16 may be about 1200 μm.

In the surface-mount inductor 100, each third metallic plate portion 16 that is connected to the first metallic plate portion 12 via the second metallic plate portion and that also serves as a coil conductor is embedded such that the surface thereof is exposed on the bottom surface of the molded body 10, thereby forming an external terminal. Thus, the fixing strength between the external terminal and the molded body is good. In addition, in the surface-mount inductor 100, the external terminal is not exposed on any side surface of the molded body. Thus, a solder fillet is not formed on any side surface in mounting the surface-mount inductor, and it is possible to improve the mounting density.

The surface-mount inductor 100 may be produced, for example, by embedding a metallic plate bent into a predetermined shape in a composite material containing magnetic powder such that the surface of each third metallic plate portion is exposed; and performing pressure molding.

Second Embodiment

Figure 2:
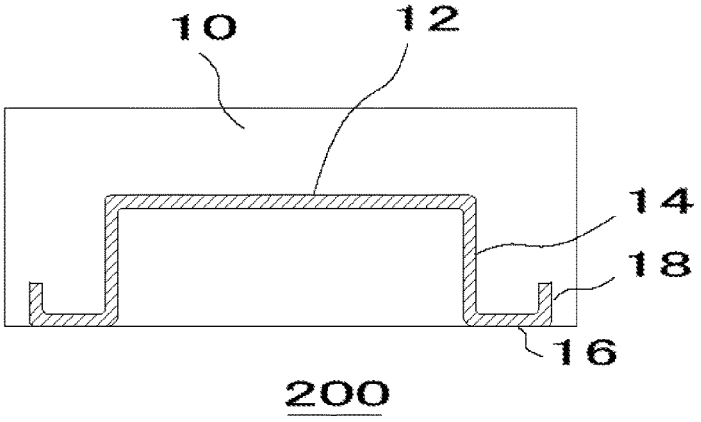
FIG. 2 is a cross-sectional view showing an example of a surface-mount inductor of a second embodiment.

A surface-mount inductor 200 of the second embodiment will be described with reference to FIG. 2. FIG. 2 is a cross-sectional view of the surface-mount inductor 200. The surface-mount inductor 200 has, at an end portion of each third metallic plate portion 16, a fourth metallic plate portion 18 that extends in a direction crossing the top surface of the molded body 10. Accordingly, the fixing strength between the external terminal and the molded body is further improved.

In the surface-mount inductor 200, the metallic plate is formed so as to have the second metallic plate portion 14, the third metallic plate portions 16, and the fourth metallic plate portions 18 that are connected in the directions of both ends of the first metallic plate portion 12. Each fourth metallic plate portion 18 is disposed so as to extend from the end portion of the third metallic plate portion 16, which is disposed on the bottom surface of the molded body 10, in a direction crossing the top surface of the molded body 10. In FIG. 2, the extension direction of each fourth metallic plate portion 18 is substantially orthogonal to the top surface of the molded body 10 but may be a direction crossing the side surface of the molded body 10 located at the side opposite to the second metallic plate portion 14.

Third Embodiment

Figure 3:
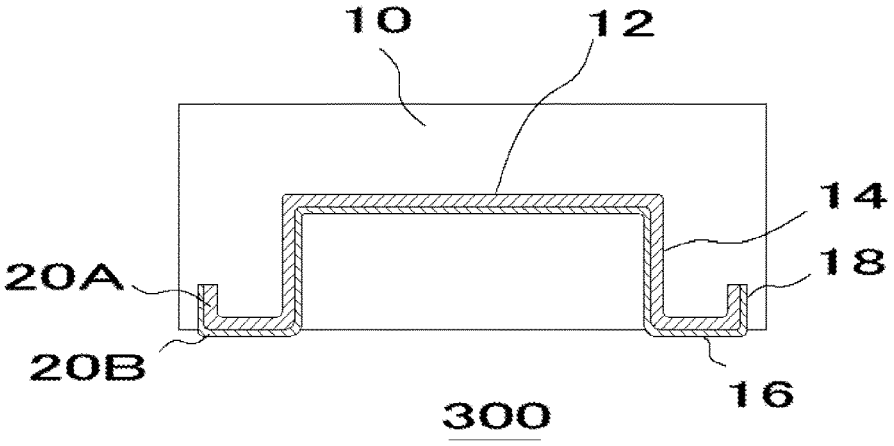
FIG. 3 is a cross-sectional view showing an example of a surface-mount inductor of a third embodiment.

A surface-mount inductor 300 of a third embodiment will be described with reference to FIG. 3. FIG. 3 is a cross-sectional view of the surface-mount inductor 300. In the surface-mount inductor 300, the metallic plate in the surface-mount inductor 200 of the second embodiment is changed to a metallic plate having a plating layer 20B on one surface of a conductive metallic base material 20A. In the surface-mount inductor 300, the plating layer 20B is provided on an exposed surface of each third metallic plate portion 16 that is exposed at the mounting surface side of the molded body 10, and thus the solder wettability is improved and the mounting strength and the reliability are further improved.

In the surface-mount inductor 300, in the metallic plate, the plating layer 20B is formed on one surface of the conductive metallic base material 20A such as copper. The plating layer 20B is formed, for example, so as to include a nickel (Ni) plating that is a first layer provided in contact with the metallic base material 20A and a tin (Sn) plating that is a second layer provided on the first layer. The metallic plate is formed so as to have the first metallic plate portion 12, the second metallic plate portions 14, the third metallic plate portions 16, and the fourth metallic plate portions 18 that are connected, and each third metallic plate portion 16 has the plating layer 20B on the surface thereof exposed from the molded body 10.

Fourth Embodiment

Figure 4:
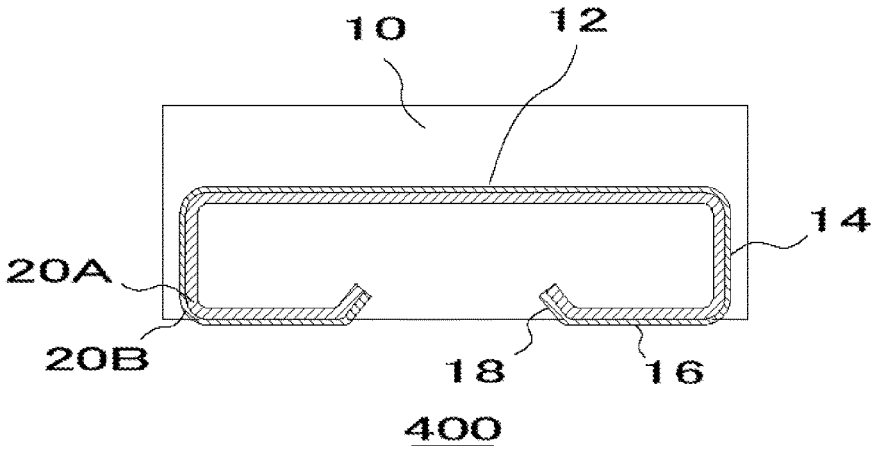
FIG. 4 is a cross-sectional view showing an example of a surface-mount inductor of a fourth embodiment.

A surface-mount inductor 400 of a fourth embodiment will be described with reference to FIG. 4. FIG. 4 is a cross-sectional view of the surface-mount inductor 400. In the surface-mount inductor 400, each third metallic plate portion 16 extend on the bottom surface of the molded body 10 from one second metallic plate portion toward the other second metallic plate portion. That is, the third metallic plate portions 16 extend in directions opposite to each other. Furthermore, the fourth metallic plate portion 18 that is each end portion of the metallic plate is embedded again in the inward direction of the molded body 10. Moreover, the metallic plate has the plating layer 20B on one surface of the conductive metallic base material 20A. In the surface-mount inductor 400, since each end of the metallic plate is embedded again in the inward direction of the molded body, the fixing strength between the external terminal portion and the molded body is further improved. In addition, in the surface-mount inductor 400, since each third metallic plate portion 16 extends in a direction away from the side surface of the molded body 10, it is possible to increase the length of each first metallic plate portion 12, and it is possible to easily achieve desired inductance at the coil conductor portion composed of the first metallic plate portion, the second metallic plate portions, and the third metallic plate portions.

In the surface-mount inductor 400, the metallic plate is formed such that the plating layer 20B is an outer side portion, and the first metallic plate portion 12, the second metallic plate portions 14, the third metallic plate portions 16, and the fourth metallic plate portions 18 are formed. In the surface-mount inductor 400, each third metallic plate portion 16 exposes the plating layer 20B from the bottom surface of the molded body 10. In addition, each second metallic plate portion 14 is disposed so as to be separated from the side surface of the molded body 10, and the metallic plate is not exposed on any side surface of the molded body 10. Each fourth metallic plate portion 18 of the metallic plate extends from the bottom surface of the molded body 10 in the inward direction. In FIG. 4, each fourth metallic plate portion 18 is bent such that the interior angle thereof relative to the third metallic plate portion 16 is an obtuse angle. However, each fourth metallic plate portion 18 may be bent so as to be orthogonal to the bottom surface of the molded body 10.

Fifth Embodiment

Figure 5:
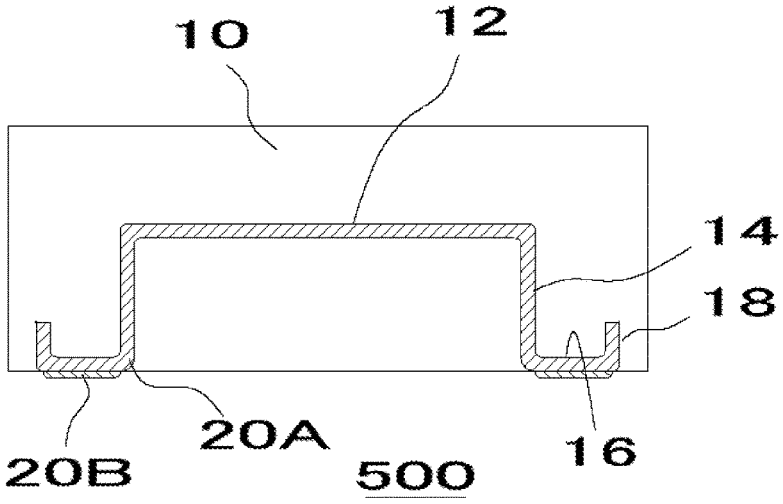
FIG. 5 is a cross-sectional view showing an example of a surface-mount inductor of a fifth embodiment.

A surface-mount inductor 500 of a fifth embodiment will be described with reference to FIG. 5. FIG. 5 is a cross-sectional view of the surface-mount inductor 500. In the surface-mount inductor 500, the plating layer of the metallic plate in the surface-mount inductor 300 of the third embodiment is provided not on the entirety of one surface of the metallic base material 20A, but on only the surface of each third metallic plate portion 16 that is exposed on the bottom surface of the molded body 10. Accordingly, it is possible to reduce a material required for a plating treatment.

It is possible to produce the surface-mount inductor 500 by plating the exposed surface of each third metallic plate portion 16 after the surface-mount inductor 200 is prepared.

Sixth Embodiment

Figure 6:
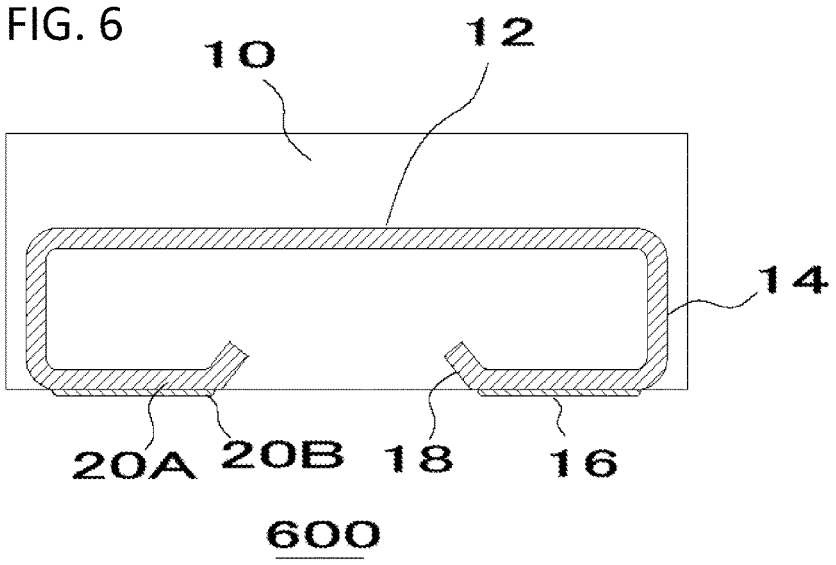
FIG. 6 is a cross-sectional view showing an example of a surface-mount inductor of a sixth embodiment.

A surface-mount inductor 600 of a sixth embodiment will be described with reference to FIG. 6. FIG. 6 is a cross-sectional view of the surface-mount inductor 600. In the surface-mount inductor 600, the plating layer of the metallic plate in the surface-mount inductor 400 of the fourth embodiment is provided not on the entirety of one surface of the metallic base material 20A, but on only the surface of each third metallic plate portion 16 that is exposed on the bottom surface of the molded body 10. Accordingly, it is possible to reduce a material required for a plating treatment.

It is possible to produce the surface-mount inductor 600 by plating the exposed surface of each third metallic plate portion 16 after the surface-mount inductor 400 is prepared.

Seventh Embodiment

Figure 7:
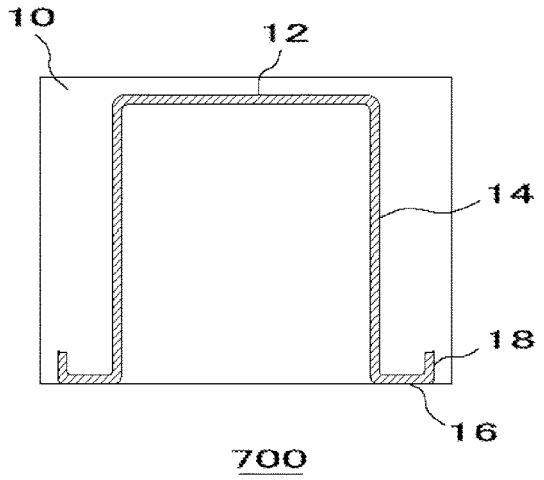
FIG. 7 is a cross-sectional view showing an example of a surface-mount inductor of a seventh embodiment.

A surface-mount inductor 700 of a seventh embodiment will be described with reference to FIG. 7. FIG. 7 is a cross-sectional view of the surface-mount inductor 700. In the surface-mount inductor 700, the metallic plate is formed by being bent in a similar manner to the metallic plate of the surface-mount inductor 200 of the second embodiment, but each second metallic plate portion 14 is formed so as to be longer than that of the surface-mount inductor 200.

In the surface-mount inductor 700, the metallic plate is formed so as to have the second metallic plate portions 14, the third metallic plate portions 16, and the fourth metallic plate portions 18 that are connected in the directions of both ends of the first metallic plate portion 12. The first metallic plate portion 12 is embedded close to the top surface of the molded body 10 such that the extension direction and the width direction of the metallic plate are parallel to the mounting surface. Each second metallic plate portion 14 is disposed so as to be separated from the side surface of the molded body 10, and the extension direction thereof is substantially orthogonal to the bottom surface. The two second metallic plate portions 14 are connected to each other by the first metallic plate portion. Each third metallic plate portion 16 is extended from the bottom surface of the molded body 10 and extends along the bottom surface in a direction to the side surface at the side opposite to the second metallic plate portion 14. Each fourth metallic plate portion 18 is connected to the end portion of the third metallic plate portion 16 at the side opposite to the second metallic plate portion 14. Each fourth metallic plate portion 18 extends in a direction to the top surface of the molded body 10.

By making the first metallic plate portion close to the top surface of the molded body as described above, it is possible to increase the length of each second metallic plate portion, and it is possible to easily achieve desired inductance at the coil conductor portion composed of the first metallic plate portion, the second metallic plate portions, and the third metallic plate portions.

Eighth Embodiment

Figure 8:
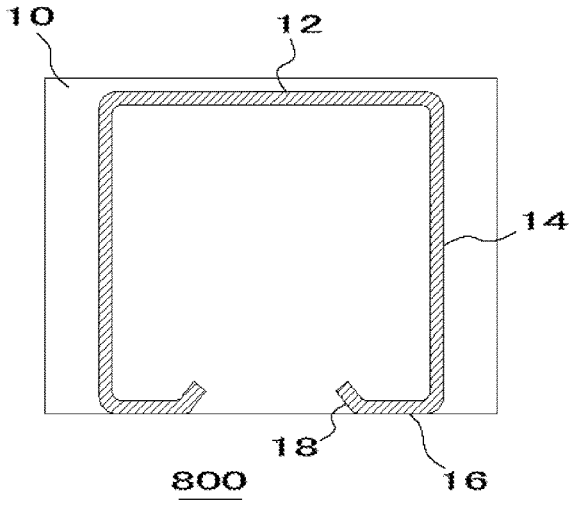
FIG. 8 is a cross-sectional view showing an example of a surface-mount inductor of an eighth embodiment.

A surface-mount inductor 800 of an eighth embodiment will be described with reference to FIG. 8. FIG. 8 is a cross-sectional view of the surface-mount inductor 800. In the surface-mount inductor 800, the metallic plate is formed by being bent in a similar manner to the metallic plate of the surface-mount inductor 400 of the fourth embodiment, but each second metallic plate portion 14 is formed so as to be longer than that of the surface-mount inductor 400. In addition, the metallic plate does not have a plating layer.

In the surface-mount inductor 800, the metallic plate is formed so as to have the second metallic plate portions 14, the third metallic plate portions 16, and the fourth metallic plate portions 18 that are connected in the directions of both ends of the first metallic plate portion 12. The first metallic plate portion 12 is embedded close to the top surface of the molded body 10 such that the extension direction and the width direction of the metallic plate are parallel to the mounting surface. Each second metallic plate portion 14 is disposed so as to be separated from the side surface of the molded body 10, and the extension direction thereof is substantially orthogonal to the bottom surface. The two second metallic plate portions 14 are connected to each other by the first metallic plate portion. Each third metallic plate portion 16 is extended from the bottom surface of the molded body 10 and extends along the bottom surface in a direction to the second metallic plate portion connected to the other third metallic plate portion. Each fourth metallic plate portion 18 is connected to the end portion of the third metallic plate portion 16 at the side opposite to the second metallic plate portion 14. Each fourth metallic plate portion 18 extends in the direction crossing the top surface of the molded body 10.

In the above-described surface-mount inductors, the first metallic plate portion or each second metallic plate portion has a linear shape and forms a coil conductor portion, but the first metallic plate portion or each second metallic plate portion may have a coil shape bent in the width direction.

In addition, the size of the molded body and the size of the metallic plate may be changed as appropriate in accordance with the characteristics of the inductor.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A surface-mount inductor comprising a molded body formed from a composite material containing magnetic powder; and a metallic plate embedded in the molded body so as to be partially exposed at a mounting surface side, wherein the metallic plate has a first metallic plate portion that is embedded in the molded body such that an extension direction and a width direction thereof are parallel to the mounting surface; second metallic plate portions that respectively extend from both end portions, in the extension direction, of the first metallic plate portion to a bottom surface of the molded body in a direction to the mounting surface; and third metallic plate portions that are disposed so as to extend from the second metallic plate portions along the bottom surface of the molded body and be separated from side surfaces adjacent to the bottom surface of the molded body, and each of the third metallic plate portions having at least a surface exposed from the molded body, end portions of the metallic plate are embedded so as to be separated from the side surfaces of the molded body, each third metallic plate portion extends from the second metallic plate portion in a direction to the second metallic plate portion to which the other third metallic plate portion is connected, each third metallic plate portion has a plating layer on the surface thereof exposed from the molded body, and end portions of each third metallic plate portion are not exposed from the side surfaces of the molded body.

2. The surface-mount inductor according to claim 1, wherein the metallic plate further has fourth metallic plate portions that extend from end portions of the third metallic plate portions at sides opposite to the second metallic plate portions, in a direction crossing a top surface of the molded body opposing the mounting surface.

3. The surface-mount inductor according to claim 1, wherein the magnetic powder includes metallic magnetic powder.

4. The surface-mount inductor according to claim 2, wherein the magnetic powder includes metallic magnetic powder.

* * * * *